United States Patent [19]

Marshall et al.

[11] Patent Number: 4,981,230

[45] Date of Patent: Jan. 1, 1991

[54] COMPOSITE CAP INCLUDING TAMPER INDICATING BAND

[75] Inventors: F. Paul Marshall, Orland Park; Frank H. Lecinski, Champaign; Douglas G. Begley, Palatine, all of Ill.

[73] Assignee: Continental White Cap, Inc., Norwalk, Conn.

[21] Appl. No.: 493,745

[22] Filed: Mar. 15, 1990

[51] Int. Cl.[5] ..... B65D 41/34

[52] U.S. Cl. ..... 215/252; 213/318

[58] Field of Search ..... 215/232, 252, 253, 256, 215/258, 318, 330

[56] References Cited

U.S. PATENT DOCUMENTS

| | | | |
|---|---|---|---|
| 3,484,012 | 12/1969 | White et al. | 215/252 |
| 3,685,677 | 8/1972 | Westfall | 215/318 X |
| 3,690,497 | 9/1972 | Lecinski, Jr. | 215/318 |
| 4,458,821 | 7/1984 | Ostrowsky | 215/253 |
| 4,470,513 | 9/1984 | Ostrowsky | 215/253 |
| 4,478,343 | 10/1984 | Ostrowsky | 215/253 |
| 4,546,892 | 10/1985 | Couput | 215/253 |
| 4,550,844 | 11/1985 | Lininger | 215/252 |
| 4,576,299 | 3/1986 | Lecinski, Jr. | 215/318 |
| 4,595,110 | 6/1986 | Herr | 215/252 |
| 4,598,833 | 7/1986 | Herr | 215/258 X |
| 4,643,321 | 2/1987 | Goch | 215/252 |
| 4,653,657 | 3/1987 | Papavasilopoulos | 215/252 |
| 4,657,153 | 4/1987 | Hayes | 215/252 |
| 4,732,289 | 3/1988 | Granat et al. | 215/252 |
| 4,801,030 | 1/1989 | Barriac | 215/252 |
| 4,807,771 | 2/1989 | Roy et al. | 215/252 |
| 4,813,561 | 3/1989 | Ochs | 215/252 |
| 4,848,614 | 7/1989 | Csaszar | 215/252 |
| 4,856,665 | 8/1989 | Dutt et al. | 215/252 |
| 4,863,030 | 9/1989 | Bayer et al. | 215/318 X |
| 4,875,594 | 10/1989 | Ochs | 215/252 |

*Primary Examiner*—Stephen Marcus
*Assistant Examiner*—Vanessa M. Roberts
*Attorney, Agent, or Firm*—Charles E. Brown; Paul Shapiro; Charles A. Brown

[57] ABSTRACT

This relates to an improved tamper band construction for use in conjunction with closure caps for locking beneath a retaining bead on a container neck finish when the closure cap is removed to indicate rotation of the closure cap. The tamper indicating band is provided with a plurality of flaps which are initially molded in a radially inwardly, axial downwardly directed position and then are folded upwardly to radially inwardly and axially upwardly directed positions where they are engagable beneath a container retaining bead. Most particularly, the plurality of flaps are joined in groups by connecting bridges so that each group of flaps pivot as a unit with the connecting bridges stretching and providing an over center snapping action to retain the flaps in their operative positions after they are folded to such positions. By providing a plurality of individual flaps which are joined together only by the relatively narrow connecting bridges, washing of the container beneath the closure cap to remove excess product is facilitated.

17 Claims, 2 Drawing Sheets

COMPOSITE CAP INCLUDING TAMPER INDICATING BAND

This invention relates in general to new and useful improvements in closure caps for containers, and more particularly to closure caps having tamper indicating bands.

Most specifically, this invention relates to a closure cap component which is provided with a tamper indicating band. At the lower edge of the band there is provided a plurality of fingers which look beneath the retaining bead on a container neck finish. The fingers are arranged in groups with the fingers of each group being interconnected by a connecting bridge.

When the fingers are initially molded, they extend radially inwardly and axially downwardly and prior to the tamper indicating band being applied to a container as part of a closure cap, the fingers are folded to extend radially inwardly, but axially upwardly. The fingers are arranged in groups with fingers of each group being permanently linked together adjacent their tips by a connecting bridge. The bridge performs two functions. First, the connecting bridge increases the ability of the fingers to stay folded up in their working position. Once grouped by the connecting bridge, the tendency of the fingers to stay up is greatly increased over that of a single finger. Secondly, the bridges are small enough to allow water sprays to have access to the area between the tamper indicating band and the container neck finish which permits the removal of any excess product.

With respect to the connecting bridges retaining the flaps in their operative positions, it is to be understood that as the flaps are folded from their as molded position to their operative position, the connecting bridges stretch and provide for a snap action as the flaps move over center.

Although a preferred utilization of the tamper indicating band is in connection with an overcap, it is to be understood that the tamper indicating band construction could be utilized as an integral part of a molded plastic closure cap.

With the above and other objects in view that will hereinafter appear, the nature of the invention will be more clearly understood by reference to the following detailed description, the appended claims, and the several views illustrated in the accompanying drawings.

Figure 1:
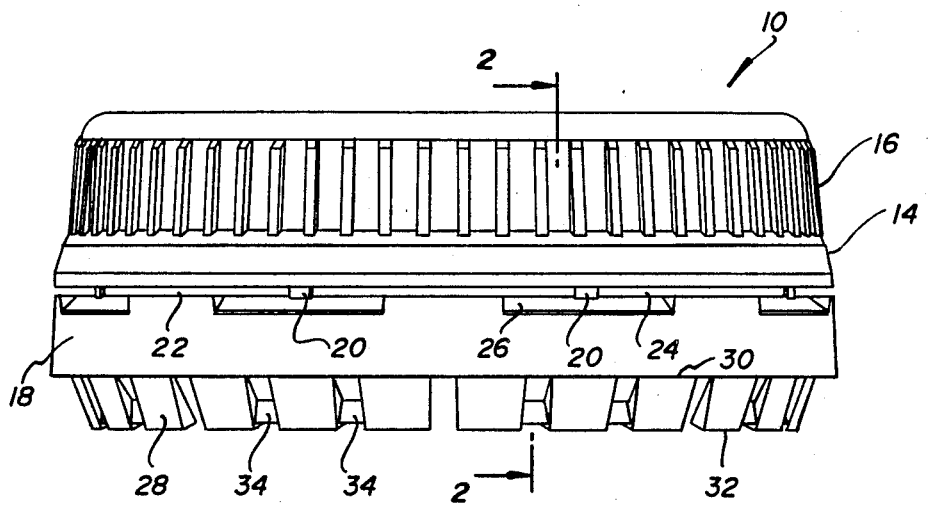
FIG. 1 is an elevational view of a closure cap as molded and shows generally the details of the connections between the fingers.
Figure 2:
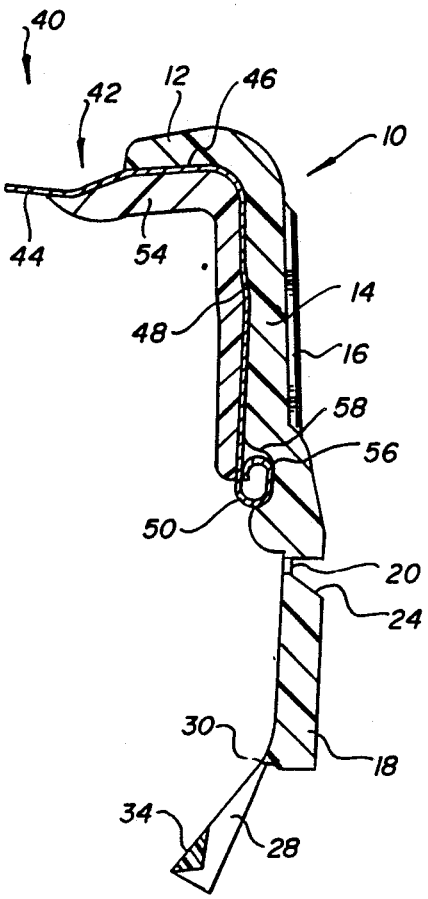
FIG. 2 is a vertical sectional view taken through the as molded over cap and applied to a metal shell of a closure cap, the view being taken generally along the line 2—2 of FIG. 1.

Referring now to the drawings in detail, it will be seen that there is illustrated in FIGS. 1 and 2 an overcap formed in accordance with this invention and utilizing the tamper indicating band which is the subject of this invention. The overcap is generally identified by the numeral 10 and, as is best shown in FIG. 2, includes an upper annular flange 12 from which an integral skirt 14 depends. The upper portion of the skirt 14 is provided with knurling 16.

The skirt 14 has integrally formed therewith a tamper indicating band 18 which is removably secured to the lower edge of the skirt 14 by a plurality of circumferentially spaced, rupturable bridges 20. It is to be understood that the tamper indicating band 18 is otherwise separate from the skirt 14 and is spaced therefrom by way of a groove 22. Each of the rupturable bridges 20 is located within an opening 24 having a lower boundary 26. Each opening 24, as well as the associated rupturable bridge 20, is defined by retractable blades (not shown) forming part of the mold in which the overcap 10 is formed. The surfaces 26 function as push-blocks to aid in the ejection of the overcap 10 from an associated mold. These push-blocks 26 also help prevent distortion and breakage of the bridge area when the associated edge of the tamper indicating band 18 is being pushed during ejection of the overcap 10 from the injection mold.

At this time it is pointed out that it is known to provide a tamper indicating band with a depending flange which is continuous and which is folded up for engagement beneath a retaining bead of an associated container neck finish. It is also known to form the band in the form of individual flaps.

In accordance with this invention, in order that the tamper indicating band 18 may be locked on a container beneath a retaining bead of a container neck finish (to be described in detail hereinafter), there is intergrally molded with the lower edge of the tamper indicating band 18 a plurality of individual flaps 28. Each of the flaps 28 is generally of a triangular cross section and has a narrow hinged connection 30 with the tamper indicating band while terminating in a relatively thick tip 32. The flaps 28 are distinguished in that they are arranged in groups with the flaps 28 of each group being joined together by connecting bridges 34. It is preferred that the flaps 34 in each group be at least three in number.

As is best shown in FIG. 2, each flap 28 has its hinged connection 30 with the tamper indicating band at the lower inside of the tamper indicating band 18.

Referring now most significantly to FIG. 2, it will be seen that the overlap 10 is applied to a closure cap generally identified by the numeral 40. The closure cap 40 is of a conventional type and includes a metal shell 42. The metal shell 42 includes an end panel 44 of which a radially outer portion is in the form of a downwardly opening channel 46. The shell 42 also includes a depending skirt 48 which is of a generally stepped configuration so that the lower portion thereof is of a greater diameter than the upper portion. The skirt 48 terminates in an outwardly and upwardly configurated curl 50.

Figure 3:
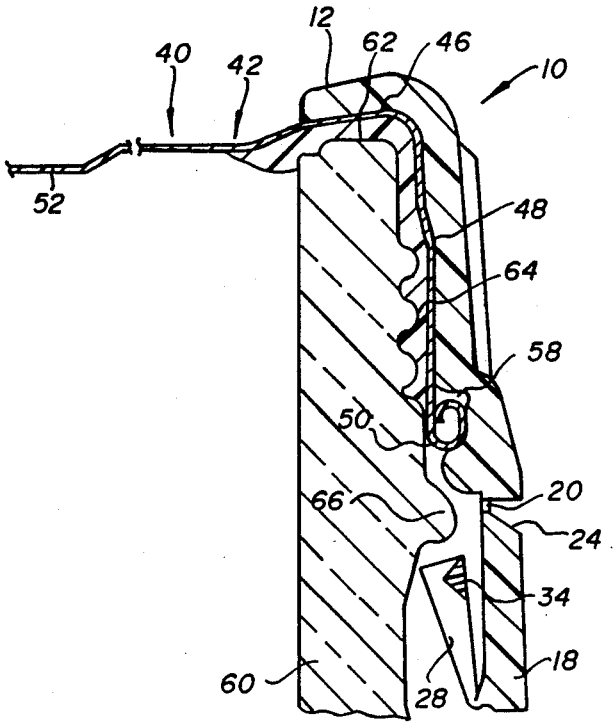
FIG. 3 is a view similar to FIG. 2 but shows the closure cap, including the overcap, applied to a container.

As best shown in FIG. 3, the end panel 44 is provided with a central vacuum loss indicating button 52.

Referring once again to FIG. 2, it will be seen that the shell 42 is provided with a suitable sealing compound 54, such as plastisol, which fills the channel 46 and also lines the skirt 48. The sealing compound 54 which lines the skirt 48 serves to form threads to facilitate the removal of the closure cap 40 in a manner to be described hereinafter.

In order to provide clearance for the curl 50, the lower portion of the skirt 14 is provided on the radially inner surface thereof with an annular groove 56. While it is preferred that there be an interference fit between the overcap 10 and the shell 42, and the stepped configuration of the skirt 48 as well as the connection of the curl 50 with the skirt 14 facilitating this, in certain instances it may be necessary to bond the overcap 10 to the shell 42 by way of an adhesive. It will be readily apparent that when the overcap 10 is forced down over the shell 42, any excess adhesive will be extruded towards the curl 50. By making the groove 56 of a greater height than the curl 50, there is provided a well 58 for the excess adhesive.

Referring now to FIG. 3, it will be seen that the closure cap 40 has been applied to a container 60 which includes an end sealing surface 62 and has external upper threads 64. Spaced below the threads 64, the neck finish of the container 60 includes a retaining bead 66.

With the flaps 28 in their upwardly folded positions, the closure cap 40 is pressed down onto the neck finish of the container 60. As a result, the sealing surface 62 will become embedded within the sealing compound 54 generally within the channel 46. Further, the sealing compound which lines the skirt 48 flows around the threads 64 and forms in that sealing compound matching threads.

As the closure cap 40, together with the overcap 10, is pressed down onto the container 60, the flaps 28 will engage and ride over the retaining bead 66. Thus the flaps 28 serve to lock the tamper indicating band 18 onto the container neck finish against removal.

Figure 4:
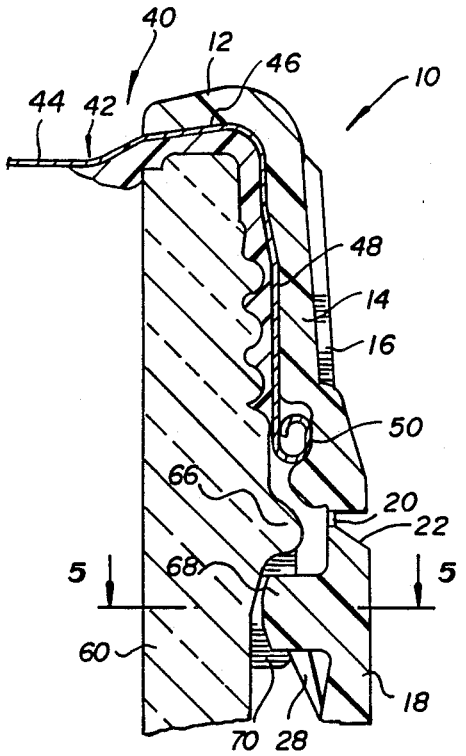
FIG. 4 is a vertical sectional view similar to FIG. 3, but rotated circumferentially so as to illustrate the circumferential interlock of a nib on the tamper indicating band and a rib on the container neck finish.
Figure 5:
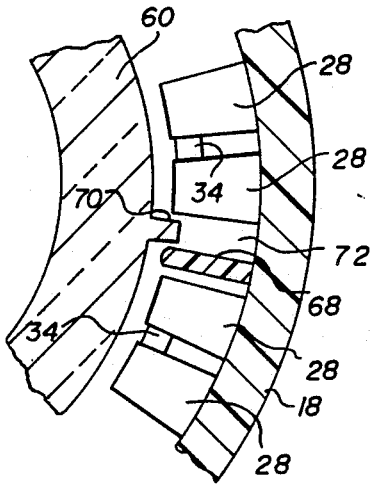
FIG. 5 is a fragmentary horizontal sectional view taken generally along the line 5—5 of FIG. 4 and shows the specific relationship of the interlock between the nib and the rib.

Referring now to FIGS. 4 and 5, it will be seen that the tamper indicating band 18 is provided with circumferentially spaced, radially inwardly directed nibs 68. The nibs 68 are disposed below the retaining bead 66 and are positioned to engage circumferentially behind radially outwardly projecting ribs 70 formed on the neck finish of the container 60 below the retaining bead 66. This is best shown in FIG. 5.

It will be readily apparent from FIG. 5 that when the closure cap 40 and the overcap 10 are twisted or rotated to effect removal of the closure cap 40 from the container 60, the tamper indicating band 18 will be prevented from rotating with the thought that the rupturable bridges 20 will rupture to indicate cap rotation before the seal between the end finish 62 and the sealing compound 54 is broken. In any event, the tamper indicating band 18 may be released no later than the time at which the vacuum within the container 60 is released so as to permit the eversion of the bubble 52 to indicate loss of vacuum.

It is to be understood that the groups of flaps 28 joined together by the bridges 34 are spaced apart as at 72. Further, it is to be understood that each nib 68 is aligned with a space 72. It is further to be understood that the space 72 is exaggerated in FIG. 5 and that the space 72 need not provide clearance for the ribs 70 although this has been so illustrated.

In any event, the engagement of the flaps 28 under the retaining bead 66 prevents removal of the tamper indicating band 18 with the closure cap.

The linked group of flaps provides a definite advantage. The connecting bridges 34 perform two funtions. The first is increased ability of the flaps 28 to stay folded up in their working position. Once grouped by the connecting bridges 34, the tendency of the flaps 28 to stay up is greatly increased over that of individual flaps. Further, as the flaps 28 are folded from the their as molded position to their operative positions, the connecting bridges 34 can stretch and as the flaps 28 of each group reaches an over center position, a snap action is provided by the connecting bridges 34 to urge the flaps of the group to their upstanding positions.

A second advantage of the flaps 28 being joined in groups by the connecting bridges 34 is that the connecting bridges 34 are small enough to allow water sprays to still have access to the area between the tamper indicating band and the neck finish of the container 60. In many applications, this area can collect food products or like products squeezed down as excess from the upper finish area of the container. The lack of water access to a drainage from this area, as is in the case of a continuous flap, could result in mold growth and undesirable conditions. Cleansing water is free to enter and drain from between the overcap 10 and the tamper indicating band 18 between the fracturable bridges 20 and also between the remaining gaps between individual flap segments. Drying air flow is also enhanced. Finally, the open construction resulting from lightly bridging the flaps 28 into groups allows much less opportunity for entrapment of a product or water.

Another advantage of the flaps 28 being connected into groups by the connecting bridges 34 is that the easy pivotal action of the flap groups allows for lighter capping pressures since dimensional fits between the tamper band and the container need not be as tight as they would be if a solid or continuous flap replaced the individual flaps. It will be readily apparent that the tamper band 18 need not expand during application of the closure cap. The flaps 28 flex out of the way and then lock under the corresponding retaining bead 66. The connecting bridges 34 linking the flaps 28 are sufficiently thin and the connecting bridges 34 can stretch while the flaps 28 are flexed radially outwardly during capping since at this time the flap tips are moving slightly further apart. This freedom of movement allowed by the stretching, or even breaking, of the connecting bridges 34 decreases the structural rigidity of the flap groups, especially in longer lengths.

The decreased rigidity of the flap groups during application of the closure cap further lowers required application pressures and distortion of the tamper indicating band 18 and the rupturable bridges 20. This is beneficial in sensitive applications such as when the overcap is applied as an after step following the closing of the container utilizing the closure cap 40 per se or when the tamper indicating band 18 is utilized as an intergral part of a one-piece plastic continuous thread closure (not shown) where capping becomes more difficult when the tamper indicating band resists the easy thread-on motion needed by many cappers. Extra resistance here can cause the closure cap to misalign and cross thread or cause the tamper indicating band to collapse and fold under the overcap skirt. By forming the connecting bridges 34 with a thickness of 0.005–0.012 inch, the connecting bridges 34 are sturdy enough to withstand demolding and folding upward to hold the groups in position during capping. Stretching or breaking during capping under these conditions is not only harmless, but can even be beneficial.

Figure 6:
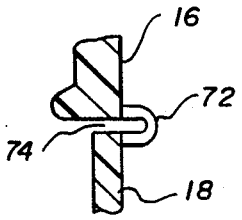
FIG. 6 is a fragmentary vertical sectional view showing a modified form of connection between the tamper indicating band and the overcap.

Reference is now made to FIG. 6 wherein the manner of integrally attaching the tamper indicating band 18 to the overcap skirt 16 is illustrated. In lieu of the necessity of providing the mold with blades for forming the openings adjacent the bridges 20, the tamper indicating band 18 can initially be directly integral with the skirt 16 of the overcap 10 and there can be provided at circumferentially spaced integrals projections 72 which overlap the line of connection between the tamper indicating band 18 and the skirt 16. Then, a slot 74 may be sawed or otherwise formed separating the tamper indicating band 18 from the skirt 16 except for the projections 72 which now function as rupturable bridges.

Although only a preferred embodiment of the closure cap, and most particularly the tamper indicating band thereof have been specifically illustrated and described herein, it is to be understood that minor variations may be made in the tamper band construction and the associated overcap without departing from the spirit and scope of the invention as defined by the appened claims.

We claim:

1. A tamper indicating band for a closure, said band being provided with a plurality of circumferentially spaced adjacent fingers extending radially inwardly and axially upwardly for engagement below a retaining bead of a container, said band being improved by said fingers being joined in groups by connecting bridges.

2. A tamper indicating band according to claim 1 wherein there are at least three of said fingers in each of said groups.

3. A tamper indicating band according to claim 1 wherein said connecting bridges are stretchable to permit individual flexing of fingers in each group.

4. A tamper indicating band according to claim 1 wherein said fingers have free tips for engaging a retaining bead, and said connecting bridges are located adjacent said tips.

5. A tamper indicating band according to claim 1 wherein said groups of fingers have spaces therebetween, and said tamper indicating band has radially inwardly directed nibs radially aligned with said spaces for engaging radially directed ribs on a container to restrict rotation of said temper indicating band relative to a container.

6. A tamper indicating band according to claim 1 wherein said band is of a molded construction and as molded said fingers extend radially inwardly and axially downwardly, and said connecting bridges form over center resilient snapping means for retaining said fingers in said radially inwardly and axially upwardly directed position once said fingers are moved to said radially inwardly and axially upwardly directed position.

7. A tamper indicating band according to claim 1 wherein said fingers have hinged connections with said band, and said fingers are spaced apart adjacent said hinged connections for facilitating washing of a filled container to remove excess product.

8. A tamper indicating band according to claim 1 wherein an upper edge of said band has rupturable bridges for connection to a closure cap member.

9. A tamper indicating band according to claim 1 wherein an upper edge of said band has rupturable bridges for connection to an overcap.

10. A closure for a container, said closure including a cap of the push-on twist-off type including a metal shell including an end panel and a depending skirt terminating in a curl, a sealing compound lining a radially outer part of said end panel to form a seal and said skirt to form thread means, a molded plastic overcap telescoped over said shell and having radially inwardly opening groove receiving said curl, said groove extending above said curl and forming a well for receiving excess of adhesive bonding said overcap to said skirt, and a tamper indicating band depending from said overcap and releasably connected to said overcap by rupturable bridges.

11. A closure according to claim 10 with said band being provided with a plurality of circumferentially spaced adjacent fingers extending radially inwardly and axially upwardly for engagement below a retaining bead of a container, said band being improved by said fingers being joined in groups by connecting bridges.

12. A closure according to claim 11 wherein there at least three of said fingers in each of said groups.

13. A closure according to claim 11 wherein said connecting bridges are stretchable to permit individual flexing of fingers in each group.

14. A closure according to claim 11 wherein said fingers have free tips for engaging a retaining bead, and said connecting bridges are located adjacent said tips.

15. A closure according to claim 11 wherein said groups of fingers have spaces therebetween, and said tamper indicating band has radially inwardly directed nibs radially aligned with said spaces for engaging radially directed ribs on a container to restrict rotation of said tamper indicating band relative to a container.

16. A closure according to claim 11 wherein said band is of a molded construction and as molded said fingers extend radially inwardly and axially downwardly, and said connecting bridges form over center resilient snapping means for retaining said fingers in said radially inwardly and axially upwardly directed position once said fingers are moved to said radially inwardly and axially upwardly directed position.

17. A closure according to claim 11 wherein said fingers have hinged connections with said band, and said fingers are spaced apart adjacent said hinged connections for facilitating washing of a filled container to remove excess product.

* * * * *